US010233519B2

(12) United States Patent
Wu et al.

(10) Patent No.: US 10,233,519 B2
(45) Date of Patent: Mar. 19, 2019

(54) SPRAY-FORMED HIGH-SPEED STEEL

(71) Applicants: HEYE SPECIAL STEEL CO., LTD., Shijiazhuang, Hebei (CN); ADVANCED TECHNOLOGY&MATERIALS CO., LTD., Beijing (CN)

(72) Inventors: Lizhi Wu, Hebei (CN); Xiaoming Li, Hebei (CN); Yunfeng Yang, Hebei (CN); Chunjiang Kuang, Hebei (CN); Dongmei Xin, Hebei (CN); Liqing Shao, Hebei (CN); Yucheng Fang, Hebei (CN)

(73) Assignees: HEYE SPECIAL STEEL CO., LTD., Shijiangzhuang, Hebei (CN); ADVANCED TECHNOLOGY&MATERIALS CO., LTD., Beijing (CN)

( * ) Notice: Subject to any disclaimer, the term of this patent is extended or adjusted under 35 U.S.C. 154(b) by 188 days.

(21) Appl. No.: 15/326,474

(22) PCT Filed: Sep. 30, 2015

(86) PCT No.: PCT/CN2015/091273
§ 371 (c)(1),
(2) Date: Jan. 14, 2017

(87) PCT Pub. No.: WO2016/184007
PCT Pub. Date: Nov. 24, 2016

(65) Prior Publication Data

US 2017/0204502 A1 Jul. 20, 2017

(30) Foreign Application Priority Data

May 15, 2015 (CN) ..... 2015 1 0249129

(51) Int. Cl.
*C22C 38/00* (2006.01)
*C22C 38/02* (2006.01)
(Continued)

(52) U.S. Cl.
CPC ..... *C22C 38/30* (2013.01); *C22C 38/002* (2013.01); *C22C 38/02* (2013.01); *C22C 38/04* (2013.01);
(Continued)

(58) Field of Classification Search
CPC ..... C22C 38/002; C22C 38/02; C22C 38/04; C22C 38/22; C22C 38/24; C22C 38/26; C22C 38/30
See application file for complete search history.

(56) References Cited

U.S. PATENT DOCUMENTS 4,948,556 A * 8/1990 Kumagai ..... C22C 38/30 148/318
5,008,072 A * 4/1991 Siga ..... C22C 38/44 148/325
(Continued)

FOREIGN PATENT DOCUMENTS

CN 1704495 12/2005
CN 101153376 4/2008
(Continued)

*Primary Examiner* — Cam N. Nguyen

(57) ABSTRACT

A spray-formed high-speed steel includes chemical components by mass percent of: C: 0.85-1.65%, Si: 0.1-1.2%, Cr: 3.5-8.0%, W: 4.0-6.5%, Mo: 4.5-7.0%, V: 1.0-4.0%, Co: 1.0-8.0%, Mn: 0.2-0.8%, and Nb: 0.2-3.5%, with balance of iron and impurities.

20 Claims, 1 Drawing Sheet

(51) Int. Cl.

| | |
|---|---|
| ***C22C 38/04*** | (2006.01) |
| ***C22C 38/22*** | (2006.01) |
| ***C22C 38/24*** | (2006.01) |
| ***C22C 38/26*** | (2006.01) |
| ***C22C 38/30*** | (2006.01) |

(52) U.S. Cl.
CPC ..... *C22C 38/22* (2013.01); *C22C 38/24* (2013.01); *C22C 38/26* (2013.01)

(56) References Cited

U.S. PATENT DOCUMENTS 5,492,573 A * 2/1996 Fukushima ..... C22C 38/26 148/325
5,508,002 A * 4/1996 Kawaguchi ..... C21D 8/065 148/334
5,817,192 A * 10/1998 Kawai ..... C22C 38/46 148/325
5,830,290 A * 11/1998 Kreipe ..... C21D 9/02 148/580
5,846,344 A * 12/1998 Kawaguchi ..... C21D 8/065 148/333
5,961,284 A * 10/1999 Kuriyama ..... C22C 38/001 415/200
6,123,504 A * 9/2000 Shiga ..... B23K 35/308 148/325
6,200,394 B1 3/2001 Park et al.
6,673,165 B2 * 1/2004 Koga ..... C22C 38/001 148/325
6,755,920 B2 * 6/2004 Kamada ..... C21D 6/002 148/335
6,761,853 B2 * 7/2004 Ishida ..... C22C 38/001 420/41
6,884,388 B2 * 4/2005 Ozaki ..... C22C 38/001 148/325
6,962,631 B2 * 11/2005 Sugiura ..... C21D 1/185 148/320
7,946,813 B2 * 5/2011 Fukuda ..... C22C 19/055 29/889.2
8,083,869 B2 * 12/2011 Takayama ..... C21D 5/00 148/321
8,361,247 B2 * 1/2013 Vartanov ..... C21D 1/25 148/325
8,562,761 B2 * 10/2013 Gunnarsson ..... C21D 1/25 148/328
8,607,941 B2 * 12/2013 Yamauchi ..... C21D 6/002 148/325
8,778,260 B2 * 7/2014 Tsuge ..... C21C 5/005 420/38
8,852,361 B2 * 10/2014 Hirasawa ..... F16D 65/125 148/325
8,900,382 B2 * 12/2014 Johansson ..... C21D 1/18 148/334
9,212,412 B2 * 12/2015 Oikawa ..... C22C 38/001
9,249,485 B2 * 2/2016 Valls ..... C22C 38/02
9,670,570 B2 * 6/2017 Kristan ..... C22C 38/54
9,816,153 B2 * 11/2017 Ono ..... C22C 38/38
9,863,016 B2 * 1/2018 Takano ..... C21D 8/06
9,863,026 B2 * 1/2018 Yokoi ..... C21D 8/0205
9,963,767 B2 * 5/2018 Urashima ..... B60K 15/04
2018/0216206 A1 * 8/2018 Yokoi ..... C21D 9/46

FOREIGN PATENT DOCUMENTS

CN 101838774 9/2010
CN 102605263 7/2012

* cited by examiner

SPRAY-FORMED HIGH-SPEED STEEL

CROSS REFERENCE OF RELATED APPLICATION

This is a U.S. National Stage under 35 U.S.C 371 of the International Application PCT/CN2015/091273, filed on Sep. 30, 2015, which claims priority under 35 U.S.C. 119(a-d) to CN 201510249129.0, filed on May 15, 2015.

BACKGROUND OF THE PRESENT INVENTION

Field of Invention

The present invention relates to a high-speed steel, and more particularly to a spray-formed high-speed steel.

Description of Related Arts

Because of the slow cooling velocity during the casting process, the high-speed steel prepared through the conventional method has a serious segregation of the alloying elements, forming coarse crystalline grains and carbides. Even after the subsequent thermal deformation process, the nonuniformity of the structure is difficult to be completely eliminated, thereby causing the performance of the high-speed steel at a relatively low level.

In order to restrain the segregation of the alloying elements during processing, for obtaining the alloy having the uniform structure, a technology, which prepares the high-speed steel and the tool and die steel through the powder metallurgy process, is developed. Although the powder metallurgy process has a relatively mature development, by which the high-quality high-speed steel is manufactured, the powder metallurgy process has the long process flow and the high manufacture cost and energy consumption, causing a high price of the product.

How to improve the product quality with the relatively low process cost is a technical problem required to be solved in the conventional high-speed steel preparation. The spray forming process provides a way to solve the above problem. Spray forming is a short flow process, for rapidly cooling and shaping the liquid steel, which is able to solve the segregation problem of the alloying elements during the conventional casting preparation process and the cost increase problem caused by the long process flow of the powder metallurgy process. The high-speed steel prepared through the spray forming process has the following problems. With spray forming, the size of the cross section of the ingot increases; during spray deposition, the solidification velocity of the liquid steel at the end of the ingot relatively decreases; and, for the high-speed steel having the characteristics of high melting temperature, wide solidification temperature range, and multiple phase compositions, the segregation of the alloying elements easily occurs at the local ingot, forming the coarse structure, which further affects the product quality.

SUMMARY OF THE PRESENT INVENTION

An object of the present invention is to provide a spray-formed high-speed steel having a uniform structure, so as to at least solve one of technical problems in prior arts to some extent.

In order to accomplish the above object, the present invention provides a spray-formed high-speed steel, comprising chemical components by mass percent of: C: 0.85-1.65%, Si: 0.1-1.2%, Cr: 3.5-8.0%, W: 4.0-6.5%, Mo: 4.5-7.0%, V: 1.0-4.0%, Co: 1.0-8.0%, Mn: 0.2-0.8%, and Nb: 0.2-3.5%, with balance of iron and impurities.

The spray-formed high-speed steel provided by the present invention has a uniform microstructure, fine carbides, a uniform distribution, and excellent comprehensive mechanical performances of hardness, impact toughness, and bending strength. Meanwhile, it is easy to process the spray-formed high-speed steel with machining and grinding. Through preparing with a spray forming process, the high-speed steel provided by the present invention has a segregation of alloying elements restrained in a small range, a short preparation process flow, and a relatively low cost, and is applicable in manufacturing various cutters, such as turning tools, hobs, broaches, and drills, and able to replace a high-speed steel prepared through a powder metallurgy process.

Preferably, W and Mo are partially and mutually replaceable, and a replacement ratio thereof is 1% Mo=2% W. Because a W alloy and an Mo alloy have similar functions in forming the carbides, W and Mo are partially and mutually replaceable in a given range, and the replacement ratio thereof is 1% Mo=2% W. A total content of (Mo+½W) is required to keep in a range of 6.0%-10.5%.

Preferably, V and Nb are partially and mutually replaceable, and a replacement ratio thereof is 1% V=2% Nb. Because V and Nb have similar functions in forming an MC carbide, V and Nb are partially and mutually replaceable in a given range, and the replacement ratio thereof is 1% V=2% Nb. A total content of (V+½Nb) is required to keep in a range of 1.0%-6.0%.

Preferably, the spray-formed high-speed steel comprises chemical components by mass percent of: C: 0.95-1.50%, Si: 0.3-0.6%, Cr: 4.0-6.5%, W: 4.6-6.0%, Mo: 4.8-6.0%, V: 1.5-4.0%, Co: 1.0-6.0%, Mn: 0.2-0.6%, and Nb: 0.5-2.0%, with balance of iron and impurities.

Preferably, the impurities comprise S, wherein a content of S is not more than 0.1%. Because S is a harmful element in the steel, excessive S causes a decrease of high temperature toughness. Thus, the content of S is not more than 0.1%.

Preferably, the impurities comprise P, wherein a content of P is not more than 0.03%.

Preferably, the carbides of the spray-formed high-speed steel comprise at least one member selected from a group consisting of an $M_6C$ carbide and the MC carbide.

Preferably, by volume percent, at least 80% of the carbides of the spray-formed high-speed steel have a size ≤15 μm. The high-speed steel provided by the present invention has the segregation of the alloying element restrained in the small range and shows the uniform microstructure. Morphology of the carbides is mainly spherical particles, and, according to statistics, at least 80 Vol % of the carbides have the size not more than 15 μm.

BRIEF DESCRIPTION OF THE DRAWINGS

By description of preferred embodiments combined with following accompanying drawings, above-described and/or additional advantages of the present invention will become obvious and easy to be understood.

DETAILED DESCRIPTION OF THE PREFERRED EMBODIMENT

Figure 1:
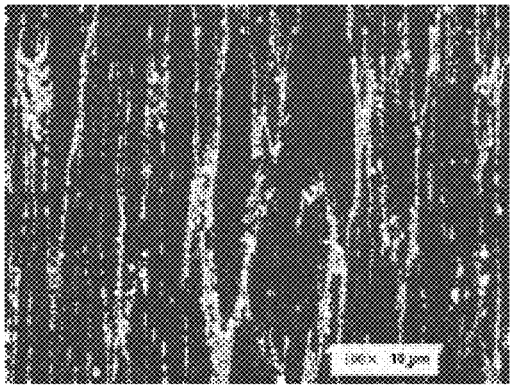
FIG. 1 is a structure analysis diagram of an alloy A.

The preferred embodiments of the present invention are described as follows in detail, and an example thereof is showed in figure, wherein the same or similar reference numbers represent the same or similar elements or elements having the same or similar functions all the time. The below preferred embodiments described through the accompanying drawings are exemplary only, for illustrating the present invention, and not intended to be limiting.

The present invention provides a spray-formed high-speed steel, comprising chemical components by mass percent of: C: 0.85-1.65%, Si: 0.1-1.2%, Cr: 3.5-8.0%, W: 4.0-6.5%, Mo: 4.5-7.0%, V: 1.0-4.0%, Co: 1.0-8.0%, Mn: 0.2-0.8%, and Nb: 0.2-3.5%, with balance of iron and impurities.

The spray-formed high-speed steel provided by the present invention has an appropriate chemical component ratio which is designed based on characteristics of a spray forming process. Through adjusting contents of main alloying elements, such as C, Cr, W, Mo, V, Nb, and Co, a generation of high-temperature stable phases is appropriately increased, a growth velocity of a phase easy to become coarse is decreased, and a segregation and structure coarsening of the alloying elements during spray forming are restrained, which realizes a structure uniformization of a spray-formed ingot and increases a mechanical performance.

C is not only a composition element of carbides, but also dissolved in a matrix for greatly strengthening the matrix. In the embodiment of the present invention, a content of carbon is at least 0.85%, so as to guarantee a full precipitation of the alloying elements. A maximum content of the carbon is not more than 1.65%, so as to avoid a matrix toughness decreasing to a low level. Within a range of 0.85-1.65%, an optimized cooperation between hardness and toughness is obtained.

Si is not involved in forming the carbides, but mainly serves as a deoxidizing agent and a strengthening element of the matrix. Excessive Si causes a decrease of the matrix toughness. According to the present invention, a content of Si is within a range of 0.1%-2.0%.

Cr is able to facilitate a precipitation of the carbides, and meanwhile has a function of increasing a hardenability for solution of the matrix. According to the present invention, a content of Cr is 3.5%-8.0%.

A precipitation of a W alloy and an Mo alloy in a form of an $M_6C$ carbide or an $M_2C$ carbide is a key of a high hardness of the high-speed steel. The $M_6C$ carbide and the $M_2C$ carbide have a hexagonal lattice structure. According to the present invention, a content of W is 4.0%-6.5%, and a content of Mo is 4.5%-7.0%.

V is mainly involved in forming an MC carbide. The MC carbide has a NaCl-type face-centered cubic lattice structure, which has obvious effects on increasing a wear resistance. Because the MC carbide has a high hardness, a formation of a coarse MC carbide is required to be avoided. According to the present invention, a content of V is 1.0%-4.0%.

Nb has a similar function as V, and is mainly involved in forming the MC carbide, so as to form a (V, Nb) C carbide. An addition of Nb is able to change a distribution of C in different carbides, which influences a precipitation process of the different carbides from liquid steel, so as to refine a particle size of the carbides. According to the present invention, a content of Nb is 0.2%-3.5%.

Co is able to facilitate the precipitation of the carbides and increase a red hardness of the high-speed steel. According to the present invention, a content of Co is 1.0%-8.0%.

An addition of Mn is able to decrease a deleterious effect of S and a hot shortness. Moreover, Mn is able to increase a hardenability of the high-speed steel. According to the present invention, a content of Mn is within a range of 0.2%-0.8%.

According to the spray-formed high-speed steel provided by the present invention, on one hand, an appropriate amount of an Nb alloying element is added for alloying, so that a stability of the MC carbide in a liquid phase region is increased and more C is involved in forming the MC carbide, which restrains the alloying elements, such as W and Mo, from reacting with C in the liquid phase region to form the $M_6C$ carbide, wherein part of the reaction between the alloying elements and C is transferred to occur in a solid phase region which is fully solidified. On the other hand, for a sufficient precipitation quantity of the $M_6C$ carbide for guaranteeing an enough harness of the high-speed steel, an appropriate amount of a Co alloying element is added, so that the $M_6C$ carbide is fully precipitated in the solid phase region; meanwhile, a growth of the precipitated carbide is restrained, and an overall particle size distribution of the carbides is in a small range, which enables the high-speed steel of the present invention to have the enough toughness for meeting application requirements.

In some embodiments, a content of (Mo+½W) in the chemical components by mass percent is 6.0%-10.5%. Because the W alloy and the Mo alloy have similar functions in forming the carbides, the W alloy and the Mo alloy are partially and mutually replaceable in a given range, and a replacement ratio thereof is 1% Mo=2% W. A total content of (Mo+½W) is required to keep in a range of 6.0%-10.5%.

In some embodiments, a content of (V+½Nb) in the chemical components by mass percent is 1.0%-6.0%. Because V and Nb have similar functions in forming the MC carbide, V and Nb are partially and mutually replaceable in a given range, and a replacement ratio thereof is 1% V=2% Nb. A total content of (V+½Nb) is required to keep in a range of 1.0%-6.0%.

In some embodiments, the spray-formed high-speed steel comprises chemical components by mass percent of: C: 0.95-1.50%, Si: 0.3-0.6%, Cr: 4.0-6.5%, W: 4.6-6.0%, Mo: 4.8-6.0%, V: 1.5-4.0%, Co: 1.0-6.0%, Mn: 0.2-0.6%, and Nb: 0.5-2.0%, with balance of iron and impurities.

In some embodiments, the impurities comprise S, and a content of S is not more than 0.1%. Because S is a deleterious element in the steel, excessive S causes a decrease of a high temperature toughness. Thus, the content of S is not more than 0.1%.

In some embodiments, the impurities comprise P, and a content of P is not more than 0.03%. Because P is a deleterious element in the steel, excessive P causes a decrease of a low temperature toughness. Thus, the content of P is not more than 0.03%.

In some embodiments, the carbides of the spray-formed high-speed steel comprise at least one member selected from a group consisting of the $M_6C$ carbide and the MC carbide.

In some embodiments, by volume percent, at least 80% of the carbides of the spray-formed high-speed steel have a size ≤15 μm. The high-speed steel provided by the present invention has a segregation of the alloying element restrained in a small range and shows a uniform microstructure. Morphology of the carbides is mainly spherical particles, and, according to statistics, at least 80 Vol % of the carbides have the size not more than 15 μm.

In conclusion, the spray-formed high-speed steel prepared through the technical solutions of the present invention has the uniform microstructure, fine carbides, a uniform distribution and excellent comprehensive mechanical performances of hardness, impact toughness, and bending strength. Meanwhile, it is easy to process the spray-formed high-speed steel with machining and grinding. Through preparing with the spray forming process, the high-speed steel provided by the present invention has the segregation of the alloying elements restrained in the small range, a short preparation process flow, and a relatively low cost, and is applicable in manufacturing various cutters, such as turning tools, hobs, broaches, and drills, and able to replace a high-speed steel prepared through a powder metallurgy process.

For one skilled in the art can better understand the present invention, some preferred embodiments of the present invention are illustrated as follows.

First Preferred Embodiment

The first preferred embodiment relates to a group of spray-formed high-speed steel, and chemical components thereof are listed in Table 1.1.

TABLE 1.1 chemical components of spray-formed high-speed steels in first preferred embodiment

| | C | Si | Cr | W | Mo | V | Nb | Co | Mn | S | P |
|---|---|---|---|---|---|---|---|---|---|---|---|
| Embodiment 1.1 | 1.23 | 0.5 | 4.5 | 5.2 | 5.5 | 1.75 | 1.0 | 5.0 | 0.3 | 0.003 | 0.02 |
| Embodiment 1.2 | 1.55 | 1.0 | 7.4 | 6.0 | 6.8 | 3.5 | 3.02 | 7.0 | 0.7 | 0.004 | 0.02 |
| Embodiment 1.3 | 0.90 | 0.2 | 3.5 | 4.2 | 4.6 | 1.32 | 0.55 | 2.5 | 0.2 | 0.003 | 0.015 |
| Embodiment 1.4 | 1.12 | 0.8 | 5.9 | 4.8 | 5.2 | 2.6 | 2.21 | 4.0 | 0.5 | 0.005 | 0.02 |

The embodiments 1.1-1.4 are prepared through the spray forming process. After finishing spray deposition, an ingot of about Φ500 mm is obtained. Through directly transferring the spray-deposited ingot for thermal deformation processing, a bar of Φ100 mm is obtained

Second Preferred Embodiment

A structure, a hardness, and an impact toughness of a spray-formed high-speed steel in the first preferred embodiment are analyzed.

The hardness is contrastively analyzed through Rockwell hardness. The impact toughness is measured through a Charpy non-notch specimen method, and a size of an impact toughness test specimen is 10 mm×10 mm×55 mm.

A spray-formed high-speed steel of embodiment 1.1, a high-speed steel bar (alloy A) of Φ100 mm which is bought commercially and prepared though an electroslag remelting and forging process, and a spray-formed bar (alloy B) of Φ100 mm which has different chemical compositions are contrastively analyzed, and results thereof are showed in Table 2.1.

TABLE 2.1 component comparison of embodiment 1.1, alloy A and alloy B

| Steel type | C | Si | Cr | W | Mo | V | Nb | Co | Mn | S | P |
|---|---|---|---|---|---|---|---|---|---|---|---|
| Alloy A | 0.92 | 0.5 | 4.0 | 6.1 | 4.85 | 1.8 | — | 5.0 | 0.4 | 0.002 | 0.02 |
| Alloy B | 1.1 | 0.5 | 3.8 | 1.4 | 9.3 | 1.1 | — | 8.0 | 0.4 | 0.003 | 0.02 |
| Embodiment 1.1 | 1.23 | 0.5 | 4.5 | 5.2 | 5.5 | 1.75 | 1.0 | 5.0 | 0.3 | 0.003 | 0.02 |

Figure 2:
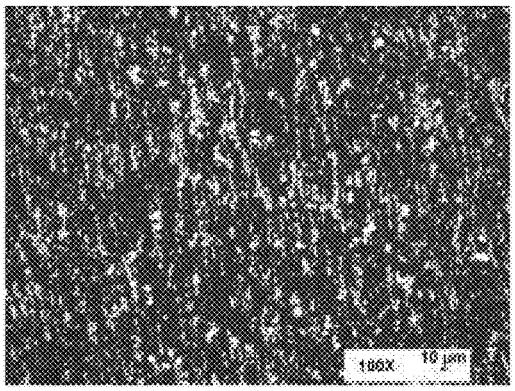
FIG. 2 is a structure analysis diagram of an alloy B.
Figure 3:
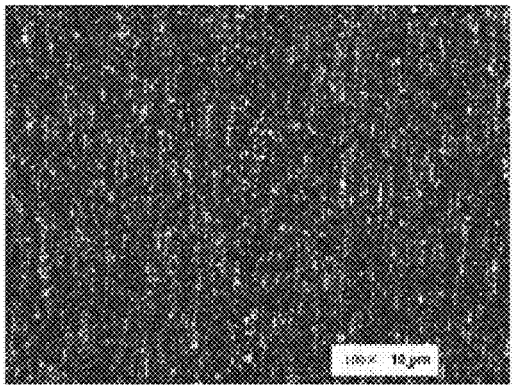
FIG. 3 is a structure analysis diagram of a spray-formed high-speed steel according to an embodiment 1.1 of the present invention.

Structures of the embodiment 1.1, the alloy A, and the alloy B are contrastively compared, as showed in FIG. 1-FIG. 3.

FIG. 1 shows a structure of a conventional electroslag-remelted steel, which has relatively coarse carbides and a stripped distribution along a longitudinal deformation direction. A nonuniform distribution of directionality of the carbides has a negative influence on mechanism, especially on a lateral mechanical performance of the steel. Through an electronic microscopy energy spectrum analysis, it is known that the carbides in FIG. 1 are mainly $M_6C$, wherein M is mainly alloying elements, such as W, Mo, and Fe. Moreover, the carbides further comprise a small number of vanadium-enriched MC carbides. A large number of the carbides in FIG. 1 have a size distributed in 5 μm-30 μm.

The steel showed in FIG. 2 is prepared though the spray forming process, which solves a problem of the stripped distribution along the longitudinal deformation direction of the carbides in the high-speed steel. However, a part of the carbides still have a coarse size, which causes an unstable working life. The carbides in FIG. 2 are mainly $M_6C$ and MC, and sizes of the carbides are mainly distributed in 3 μm-20 μm.

FIG. 3 shows the structure of the spray-formed high-speed steel provided by the present invention. It is seen that the present invention well solves problems of the nonuniform distribution of the carbides and the coarse carbides. The steel has the finest carbides and the most uniform distribution condition. In FIG. 3, the carbides are mainly $M_6C$ and MC, sizes of the carbides are mainly distributed in 0.5 μm-8 μm, and at least 80 Vol % carbides have a size ≤15 μm.

After processing with austenitizing under 1150° C., the embodiment 1.1, the alloy A, and the alloy B are quenched and then tempered respectively under 520° C., 540° C., 560° C., 580° C. and 600° C. Hardness values and impact toughness thereof are listed in Table 2.2 and Table 2.3.

TABLE 2.2 hardness comparison of embodiment 1.1, alloy A and alloy B

| | Hardness under different tempering temperatures (with quenching temperature of 1150° C.) (HRC) | | | | |
|---|---|---|---|---|---|
| Steel type | 520° C. | 540° C. | 560° C. | 580° C. | 600° C. |
| Alloy A | 65.1 | 64.0 | 63.9 | 62.2 | 59.3 |
| Alloy B | 67.5 | 67.0 | 66.0 | 64.5 | 62.5 |
| Embodiment 1.1 | 65.7 | 65.4 | 64.6 | 63.1 | 60.4 |

TABLE 2.3 impact toughness comparison of embodiment 1.1, alloy A and alloy B

| Steel type | Impact toughness under different tempering temperatures (with quenching temperature of 1150° C.) (J) | | | | |
|---|---|---|---|---|---|
| | 520° C. | 540° C. | 560° C. | 580° C. | 600° C. |
| Alloy A | 25.3 | 29.1 | 32.2 | 29.3 | 25.5 |
| Alloy B | 26.2 | 28.8 | 30.3 | 31.2 | 27.4 |
| Embodiment 1.1 | 31.1 | 34.5 | 38.5 | 35.3 | 32.6 |

From Table 2.2 and Table 2.3, it is seen that: compared with the alloy A, the embodiment 1.1 shows a relatively high hardness because of a unique design of alloying components and the spray forming process; and the alloy B shows the highest tempering hardness, because alloy components thereof has a high equivalent of W and a high content of Co. With the tempering temperature increasing from 520° C. to 600° C., the hardness of the three steels shows a decreasing trend, while the impact toughness firstly increases and then decreases. A key of a stable long working life of a high-speed steel cutter is excellent comprehensive mechanical performances of the used high-speed steel, comprising a good cooperation between the hardness and the toughness. The structure of the alloy A has an obvious nonuniform carbide distribution, and a relative large difference exists between longitudinal and lateral mechanical performances of the alloy A, which affects the working life. Compared with the alloy A and the alloy B, the embodiment 1.1 has a better toughness performance, and meanwhile has a high thermal treatment hardness, so that the embodiment 1.1 is applicable in manufacturing various cutters, such as turning tools, hobs, broaches, and drills. Because the spray forming process has a characteristic of a short flow, the embodiment 1.1 prepared through the spray forming process has a relatively low process cost. The high-speed steel provided by the present invention is able to replace a high-speed steel prepared through the powder metallurgy process in above fields.

In description of the present invention, words such as "first" and "second" are only for describing without indicating or implying a relative importance or numbers of technical features. Therefore, the feature limited by "first" or "second" may refer to one or more features. In the description of the present invention, "a plurality of" refers to at least two, except for other clear and detailed limitation.

In the description of the present invention, references such as "one embodiment", "some embodiments", "an example", "detailed example", or "some examples" mean that a detailed feature, structure, material, or characteristic of the described embodiments or examples are included in at least one embodiment or example of the present invention. In the specification, the schematic representation of the above terms is not aimed at the same embodiment or example. Furthermore, the detailed features, structures, materials, or characteristics described in any one or more of the embodiments or examples are able to be combined in a suitable manner. Moreover, one skilled in the art is able to combine the described different embodiments or examples and the features thereof if not conflicting to each other.

Although the preferred embodiments of the present invention are showed and described above, it is understandable that the preferred embodiments are exemplary only and not intended to be limiting. One skilled in the art is able to change, modify, replace and vary the above preferred embodiments within the scope of the present invention.

What is claimed is:

1. A spray-formed high-speed steel, comprising chemical components by mass percent of: C: 0.85-1.65%, Si: 0.1-1.2%, Cr: 3.5-8.0%, W: 4.0-6.5%, Mo: 4.5-7.0%, V: 1.0-4.0%, Co: 1.0-8.0%, Mn: 0.2-0.8%, and Nb: 0.2-3.5%, with balance of iron and impurities, wherein by volume percent, at least 80% of carbides of the spray-formed high-speed steel have a size ≤15 μm.

2. The spray-formed high-speed steel, as recited in claim 1, wherein W and Mo are partially and mutually replaceable with a replacement ratio of 1% Mo=2% W.

3. The spray-formed high-speed steel, as recited in claim 2, comprising chemical components by mass percent of: C: 0.95-1.50%, Si: 0.3-0.6%, Cr: 4.0-6.5%, W: 4.6-6.0%, Mo: 4.8-6.0%, V: 1.5-4.0%, Co: 1.0-6.0%, Mn: 0.2-0.6%, and Nb: 0.5-2.0%, with balance of iron and impurities.

4. The spray-formed high-speed steel, as recited in claim 2, wherein the impurities comprise S, and a content of S is not more than 0.1%.

5. The spray-formed high-speed steel, as recited in claim 1, wherein V and Nb are partially and mutually replaceable with a replacement ratio of 1% V=2% Nb.

6. The spray-formed high-speed steel, as recited in claim 5, comprising chemical components by mass percent of: C: 0.95-1.50%, Si: 0.3-0.6%, Cr: 4.0-6.5%, W: 4.6-6.0%, Mo: 4.8-6.0%, V: 1.5-4.0%, Co: 1.0-6.0%, Mn: 0.2-0.6%, and Nb: 0.5-2.0%, with balance of iron and impurities.

7. The spray-formed high-speed steel, as recited in claim 2, wherein V and Nb are partially and mutually replaceable with a replacement ratio of 1% V=2% Nb.

8. The spray-formed high-speed steel, as recited in claim 7, comprising chemical components by mass percent of: C: 0.95-1.50%, Si: 0.3-0.6%, Cr: 4.0-6.5%, W: 4.6-6.0%, Mo: 4.8-6.0%, V: 1.5-4.0%, Co: 1.0-6.0%, Mn: 0.2-0.6%, and Nb: 0.5-2.0%, with balance of iron and impurities.

9. The spray-formed high-speed steel, as recited in claim 8, wherein the impurities comprise S, and a content of S is not more than 0.1%.

10. The spray-formed high-speed steel, as recited in claim 9, wherein the impurities comprise P, and a content of P is not more than 0.03%.

11. The spray-formed high-speed steel, as recited in claim 10, wherein carbides of the spray-formed high-speed steel comprise at least one member selected from a group consisting of an $M_6C$ carbide and an MC carbide.

12. The spray-formed high-speed steel, as recited in claim 8, wherein the impurities comprise P, and a content of P is not more than 0.03%.

13. The spray-formed high-speed steel, as recited in claim 7, wherein the impurities comprise S, and a content of S is not more than 0.1%.

14. The spray-formed high-speed steel, as recited in claim 7, wherein the impurities comprise P, and a content of P is not more than 0.03%.

15. The spray-formed high-speed steel, as recited in claim 1, comprising chemical components by mass percent of: C: 0.95-1.50%, Si: 0.3-0.6%, Cr: 4.0-6.5%, W: 4.6-6.0%, Mo: 4.8-6.0%, V: 1.5-4.0%, Co: 1.0-6.0%, Mn: 0.2-0.6%, and Nb: 0.5-2.0%, with balance of iron and impurities.

16. The spray-formed high-speed steel, as recited in claim 1, wherein the impurities comprise S, and a content of S is not more than 0.1%.

17. The spray-formed high-speed steel, as recited in claim 1, wherein the impurities comprise P, and a content of P is not more than 0.03%.

18. The spray-formed high-speed steel, as recited in claim 1, wherein carbides of the spray-formed high-speed steel comprise at least one member selected from a group consisting of an $M_6C$ carbide and an MC carbide.

19. A spray-formed high-speed steel, comprising chemical components by mass percent of: C: 0.85-1.65%, Si: 0.1-1.2%, Cr: 3.5-8.0%, W: 4.0-6.5%, Mo: 4.5-7.0%, V: 1.0-4.0%, Co: 1.0-8.0%, Mn: 0.2-0.8%, and Nb: 0.2-3.5%, with balance of iron and impurities, wherein the impurities comprise P, and a content of P is 0.02% or 0.015%.

20. A spray-formed high-speed steel, comprising chemical components by mass percent of: C: 0.85-1.65%, Si: 0.1-1.2%, Cr: 3.5-8.0%, W: 4.0-6.5%, Mo: 4.5-7.0%, V: 1.0-4.0%, Co: 1.0-8.0%, Mn: 0.2-0.8%, and Nb: 0.2-3.5%, with balance of iron and impurities, wherein carbides of the spray-formed high-speed steel comprise an $M_6C$ carbide.

* * * * *